US006964144B1

(12) United States Patent
Weaver et al.

(10) Patent No.: US 6,964,144 B1
(45) **Date of Patent: *Nov. 15, 2005**

(54) SYSTEM AND APPARATUS FOR PACKAGING CONTAINERS

(75) Inventors: William N. Weaver, Northbrook, IL (US); Robert E. Ungar, Des Plaines, IL (US); Lonnie R. Seymour, Naperville, IL (US)

(73) Assignee: Illinois Tool Works Inc., Glenview, IL (US)

( * ) Notice: Subject to any disclaimer, the term of this patent is extended or adjusted under 35 U.S.C. 154(b) by 68 days.

This patent is subject to a terminal disclaimer.

(21) Appl. No.: 09/714,340

(22) Filed: Nov. 16, 2000

(51) Int. Cl.[7] ..... B65B 21/00; B65B 53/00

(52) U.S. Cl. ..... 53/398; 53/441; 53/48.4; 53/201; 53/556

(58) Field of Search ..... 53/398, 806.5, 53/441, 556, 48.1–48.5; 206/145–161

(56) References Cited

U.S. PATENT DOCUMENTS

| | | | | |
|---|---|---|---|---|
| 3,044,230 A | | 7/1962 | Fisher | |
| 3,084,792 A | | 4/1963 | Poupitch | |
| 3,383,828 A | * | 5/1968 | Cunningham | 53/398 |
| 3,830,361 A | | 8/1974 | Klygis | |
| 3,959,949 A | | 6/1976 | Benno et al. | |
| 4,250,682 A | | 2/1981 | Braun | |
| 4,301,918 A | | 11/1981 | Olsen | |
| 4,545,480 A | | 10/1985 | Klygis | |
| 4,592,466 A | | 6/1986 | Walters et al. | |
| 4,624,363 A | | 11/1986 | Edwards | |
| 4,782,955 A | | 11/1988 | Weaver et al. | |
| 4,848,565 A | | 7/1989 | Klygis | |
| 5,305,877 A | | 4/1994 | Olsen | |
| 5,383,321 A | | 1/1995 | Krogman et al. | |
| 5,579,625 A | * | 12/1996 | Olson et al. | 53/48.1 |
| 5,868,659 A | | 2/1999 | Slomski | |
| 6,006,902 A | | 12/1999 | Weaver | |
| 6,055,791 A | * | 5/2000 | Odum et al. | 53/48.4 |
| 6,056,115 A | * | 5/2000 | Olsen | 53/48.3 |
| 6,122,893 A | | 9/2000 | Weaver et al. | |
| 6,170,225 B1 | * | 1/2001 | Cervantes et al. | 53/48.4 |

FOREIGN PATENT DOCUMENTS

| | | |
|---|---|---|
| EP | 630 814 | 12/1994 |
| FR | 2 312 410 | 12/1976 |

OTHER PUBLICATIONS

"*Pet Multipackaging SYSTEMS for an evolving marketplace.*," ITW Hi-Cone®, 1140 West Bryn Mawr Avenue, Itasca, Illinois 60143, USA, Oct. 1996.

* cited by examiner

*Primary Examiner*—Stephen F. Gerrity
(74) *Attorney, Agent, or Firm*—Pauley Petersen & Erickson

(57) ABSTRACT

A system for packaging multiple containers wherein a carrier is moved through an applicating machine, the carrier constructed of flexible plastic having a plurality of elongated apertures aligned in transverse ranks, which elongated apertures are oriented in a longitudinal direction of the carrier and have a longitudinal pitch between a center of each adjacent elongated aperture, the longitudinal pitch having a first length. A plurality of containers are also moved through the applicating machine, each container of the plurality of containers spaced apart from an adjacent container by the applicating machine. The carrier is subsequently positioned over the plurality of containers whereby each elongated aperture engages with one of the containers to form a package having a container pitch between a center of adjacent containers with a second length shorter then the first length.

16 Claims, 7 Drawing Sheets

SYSTEM AND APPARATUS FOR PACKAGING CONTAINERS

BACKGROUND OF THE INVENTION

1. Field of the Invention

This invention relates to a container carrier applicating system and apparatus for unitizing a plurality of containers.

2. Description of Prior Art

Container carriers connect two or more containers into a sturdy unitized package of containers. Carriers are generally planar arrays of rings, sometimes referred to as "six-pack carriers," typically formed from a thermoplastic sheet material. Carriers are applied to containers of various sizes and shapes. One important consideration in the design of a carrier is the adaptability of the carrier to such sizes and shapes. A cost-effective carrier is capable of application to a wide range of container sizes, specifically a wide range of container diameters.

Prior art multi-packaging devices and methods generally require several different versions or configurations of applicating machines and/or carriers to accommodate different diameters of containers. Typically, a single design carrier and a single design applicating machine can accommodate a range of container diameters of approximately 0.200 inches.

Applicating machines are an additional limitation on the range of container diameters that can be effectively packaged by a single system. As described above, applicating machines are limited in the range of container diameters that they can accommodate. A major reason for this limitation is that the carrier-engaging components of an applicating machine require a constant longitudinal distance between apertures of the carrier, also called "pitch," and/or a constant transverse distance between the apertures of the container carriers. In prior art systems, containers having different diameters required container carriers having different pitches. As a result, different applicating machines were required to accommodate and apply container carriers having different pitches. Therefore, under the prior art, several carriers and several applicating machines were required to apply carriers to uniform groups of containers having different diameters.

For example, current systems require a specific carrier and specific applicating machine for containers having diameters ranging between 2.4 and 2.6 inches. A second specific carrier and a second specific applicating machine are necessary for containers having diameters ranging between 2.6 and 2.8 inches. Finally, a third specific carrier and a third specific applicating machine are necessary to accommodate container diameters up to 3.0 inches. Maintaining different applicating machines for use in connection such a wide range of containers is both expensive and space intensive for a bottling facility.

SUMMARY OF THE INVENTION

It is one object of this invention to provide a system for unitizing a plurality of containers having a range of possible container diameters.

It is another object of this invention to provide a system for unitizing a plurality of containers wherein a longitudinal pitch of a carrier is greater than a container pitch between adjacent containers in a resulting package.

A system for packaging multiple containers includes a carrier that moves through an applicating machine having a drum. The carrier is positioned around a perimeter of the drum, and rotates onto uniform groups of containers having a first diameter. The containers are assembled and unitized in a single package. After a brief set-up period, a uniform group of containers having a second diameter may be packaged with the system according to this invention. A modified carrier having a different transverse width but an identical pitch is used to package the group of containers having the second diameter.

The carrier comprises a flexible plastic sheet formed with a plurality of elongated apertures aligned in transverse ranks and at least two longitudinal rows. Additionally, the carrier is formed with a plurality of relief holes positioned between adjacent longitudinal rows of the elongated apertures. Longitudinal extremities of the relief holes overlap end portions of adjacent elongated apertures in the longitudinal direction. With this overlapping configuration, the carrier avoids high stress regions that may otherwise develop in a carrier having such elongated apertures.

Each configuration of the carrier accommodates a group of like-sized containers having a uniform diameter within a limited range of diameters. The carrier is preferably reconfigured, by widening the carrier in the transverse direction and maintaining a constant pitch, for groups of container diameters outside of the limited range.

The carrier includes a longitudinal pitch between adjacent elongated apertures that has a first length prior to application to containers. Subsequent to application to a plurality of containers, a container pitch between adjacent containers in the package is a second length, shorter than the first length. Therefore, the maximum diameter of the containers and/or the spacing between adjacent containers prior to application of the carrier does not affect the relationship between the first length and the second length. The resulting second length (container pitch) after application of the carrier to the containers is always shorter than, or equal to, the first length (longitudinal pitch) of the carrier prior to application of the carrier to the containers.

The carrier is spooled through the applicating machine and around the drum mentioned above. A plurality of jaw pairs are equally spaced around a perimeter of the drum. Each jaw pair comprises at least a moveable jaw and a fixed jaw. Each jaw pair is movable between a closed position and an open position along an axis parallel to the axis of the drum.

The carrier is fed onto the drum so that initially the jaw pairs are in the closed position and each jaw pair grips the carrier through a transverse pair of elongated apertures in the carrier. The circumferential spacing between adjacent jaw pairs is preferably approximately equal to the pitch of the carrier. The spacing between the moveable jaw and the fixed jaw in the closed position is preferably slightly less than the width between transverse pairs of elongated apertures.

The drum also includes an adjustment means for adjusting a distance between the moveable jaw and the fixed jaw of each jaw pair in the closed position. Preferably, the adjustment means simultaneously adjusts each fixed jaw of each jaw pair.

The adjustment means preferably comprises a stationary hub journaled with respect to an adjustable hub, so that the adjustable hub is slidably connected with respect to the stationary hub. A center hub assembly together with several adjuster guide assemblies are positioned between the stationary hub and the adjustable hub so that the drum is quickly and easily adjustable between applications to containers having different diameters.

If a group of containers having a different diameter is packaged, the adjustment means is adjusted so that the jaw pairs can engage a carrier having a different width but a common pitch from the prior carrier. If a smaller diameter container is packaged, usually a smaller width carrier is required so the adjustable hub is moved inward with respect to the stationary hub. The distance between the moveable jaw and the fixed jaw in the closed position is thereby reduced and the smaller carrier is engaged with the jaw pairs for application to the smaller diameter containers. If a container having a larger diameter is packaged, the adjustable hub is moved outward with respect to the stationary hub and the distance between the moveable jaw and the fixed jaw in the closed position is expanded.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
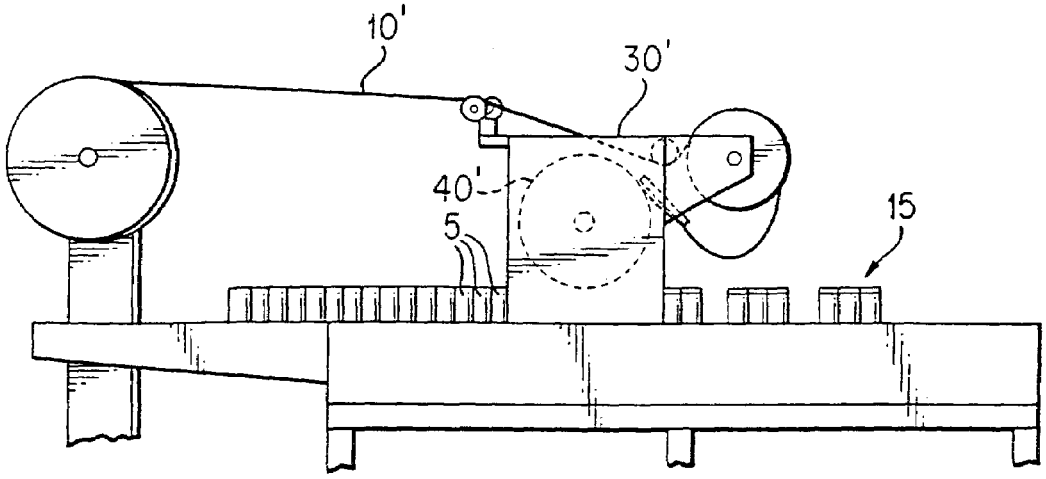
FIG. 1 PRIOR ART
FIG. 1 is a diagrammatic side view of a prior art applicating machine for packaging containers.

FIG. 1 shows a prior art system for packaging containers. As shown in FIG. 1, the prior art system comprises carrier 10' that moves through applicating machine 30' around drum 40' and onto containers 5 to create assembled package 15. As shown in FIG. 1, containers 5 are generally of uniform size and diameter throughout the packaging process. A uniform group of containers 5 having a second diameter typically requires a separately configured carrier 10' as well as a separate applicating machine 30" (not shown).

Figure 2:
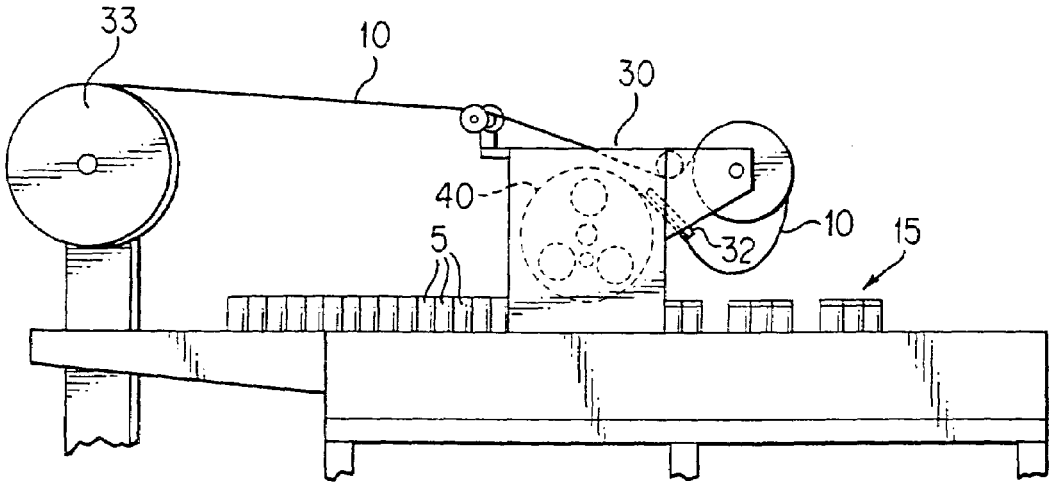
FIG. 2 is a diagrammatic side view of an applicating machine for packaging multiple containers, according to one preferred embodiment of this invention.

FIG. 2 shows a system for packaging multiple containers according to one preferred embodiment of this invention. As shown, carrier 10 moves through applicating machine 30 and through guide plate 32 to drum 40. Drum 40, having carrier 10 positioned around perimeter, rotates over and onto uniform groups of containers 5 having a first diameter. Containers 5 are assembled and unitized in a single package 15. According to one preferred embodiment of this invention, if a uniform group of like-sized containers 5 having a second diameter requires packaging, a separately configured carrier 10 having an identical pitch as carrier 10 for containers having the first diameter is positioned in applicating machine 30 after adjustment of drum 40, as described below.

Therefore, the system for packaging multiple containers 5 according to this invention permits the use of a single applicating machine 30 in combination with a variety of diameters of containers 5 and therefore sizes of carriers 10. Applicating machines 30 are typically fifteen or more feet long and six or more feet wide, therefore a reduction in the number of applicating machines 30 required in a packaging plant significantly reduces the required working floor space within the plant.

Carrier 10 preferably moves through applicating machine 30 from reel 33 ultimately to packages 15, each package 15 containing a plurality of uniform containers 5. A typical configuration for package 15 is a "six-pack" containing two longitudinal rows of containers 5 in three transverse ranks. Carriers 10 are typically connected end-to-end in a continuous planar sheet which is preferably rolled onto reels 33 for spooling onto applicating machine 30.

Figure 3:
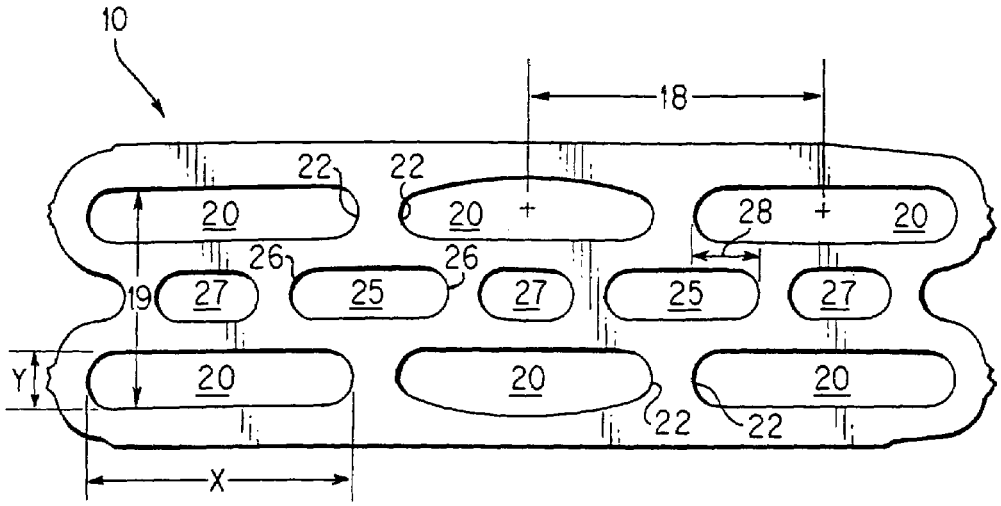
FIG. 3 is a diagrammatic top view of a carrier according to one preferred embodiment of this invention.
Figure 4:
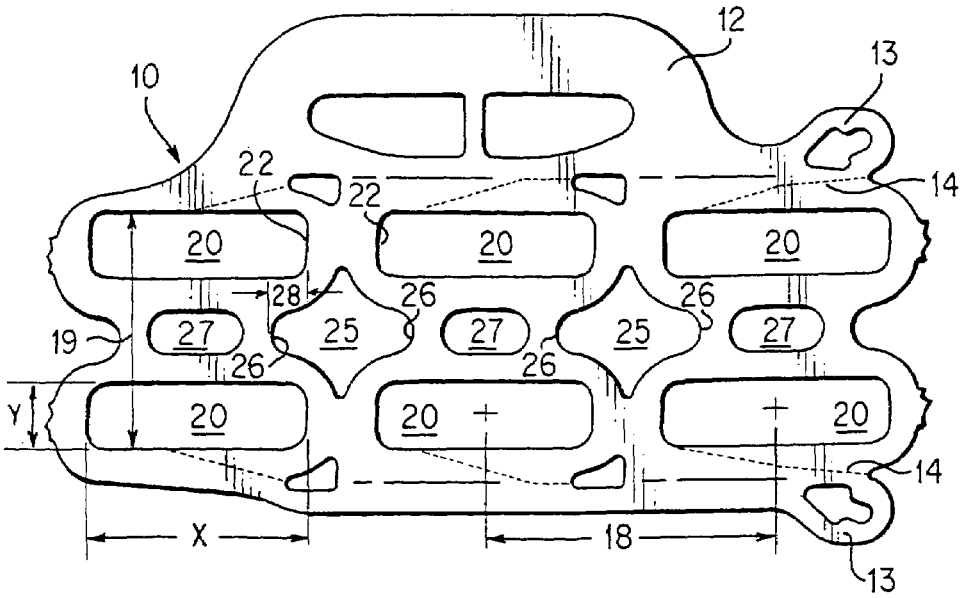
FIG. 4 is a diagrammatic top view of a carrier according to another preferred embodiment of this invention.

Carrier 10 is preferably constructed from a flexible plastic sheet, such as low-density polyethylene. As shown in FIGS. 3 and 4, the flexible plastic sheet is punched or otherwise formed into a plurality of elongated apertures 20 aligned in transverse ranks and at least two longitudinal rows to form a continuous sheet of carriers 10. Elongated apertures 20 are preferably oriented in a longitudinal direction with respect to carrier 10. In one preferred embodiment of this invention, elongated apertures 20 are approximately four to six times longer than wide. Such an elongated configuration permits carrier 10 to accommodate several diameters of containers 5 without varying pitch 18 of carrier, i.e. a longitudinal center-to-center distance between adjacent elongated apertures 20, for example a 3" pitch 18 in combination with a 2¼" diameter of container 5 or with a 2½" diameter of container 5. This elongated configuration permits a single carrier 10 to be used on a single applicating machine 30 across an approximately 0.200" range of diameters of containers 5. This elongated configurations further permits the use of several carriers 10 having a constant pitch to be used on a single applicating machine 30 across a wide range of diameters of containers 5.

Unlike typical container receiving apertures in the prior art, elongated apertures 20 are longer in a longitudinal direction than a diameter of container 5 to be engaged. As described above, elongated apertures 20 also differ from the container receiving apertures in the prior art in that elongated apertures 20 are approximately four to six times longer in the longitudinal direction than wide in a transverse direction. Prior art container receiving apertures generally have a longitudinal length (x) to transverse width (y) ratio (x/y) of 1.00 to 2.00. Therefore, typical prior art container receiving apertures are between 1 and 2 times longer in the longitudinal direction than wide in a transverse direction. Prior art container receiving apertures typically have longitudinal length to container diameter (d) ratios (x/d) between 0.80 to 1.00. Therefore, prior art container receiving apertures typically have a longitudinal length the same or less than the diameter of the container. By comparison, in one preferred embodiment of this invention, elongated apertures 20 have an x/y value of 4.90 and an x/d value of 1.05.

Additionally, carrier 10 is formed with a plurality of relief holes 25. Relief holes 25 are preferably positioned between adjacent longitudinal rows of elongated apertures 20. Relief holes 25 are preferably positioned in a single row in generally parallel alignment with respect to each adjacent relief hole 25. As shown in FIG. 3, relief holes 25 may be parallel with respect to one another, though not necessarily.

In one preferred embodiment of this invention, longitudinal extremities 26 of relief holes 25 overlap end portions 22 of adjacent elongated apertures 20 in the longitudinal direction. If carrier 10 does not contain overlap area 28 between relief holes 25 and elongated apertures 20, high stress regions will form in areas immediately adjacent relief holes 25. Such high stress regions may result in failure of carrier 10 when assembled with containers 5. Overlap area 28 between relief holes 25 and elongated apertures 20 results in the effective formation of two distinct bands in the transverse region between the rows of elongated apertures 20. In one preferred embodiment of this invention, shown in FIGS. 3 and 4, center holes 27 are formed between each adjacent relief hole 25 in a single row in generally parallel alignment. Center holes 27 add flexibility to carrier 10 and further represent a savings in required material for each carrier 10.

As shown in FIG. 4, carrier 10 may also include features such as handle 12 for holding carrier 10. Additionally, features such as tear tabs 13 and perforations 14 may be included in carrier 10 to ease removal of containers 5 from carrier 10.

Each configuration of carrier 10 preferably accommodates a group of containers 5 having a uniform diameter within a range of diameters of approximately 0.2". Carrier 10 is preferably reconfigured for groups of container diameters in increments of approximately 0.2". Each different configuration of carrier 10 is preferably wider in a transverse direction of carrier 10, such as width 19 between outer edges of elongated apertures 20. Regardless of diameter of container 5 or width of carrier 10, each configuration of carrier 10 preferably maintains an approximately constant longitudinal pitch 18 between each elongated aperture 20.

Figure 10:
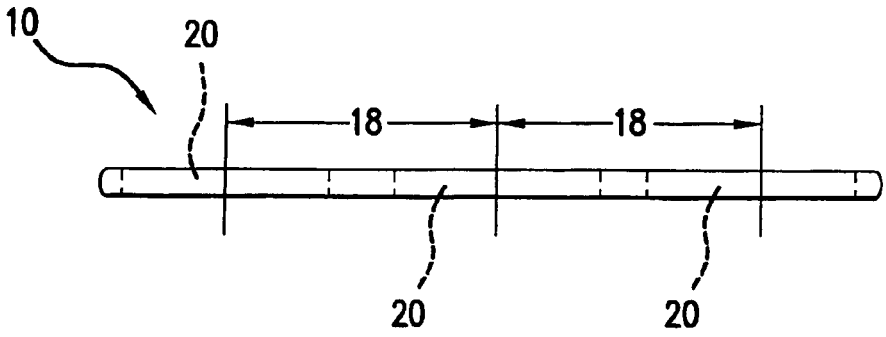
FIG. 10 is a side view of a carrier according to one preferred embodiment of this invention.

According to one preferred embodiment of this invention, a system for packaging multiple containers 5 includes moving carrier 10 through applicating machine 30 wherein carrier 10 includes longitudinal pitch 18 between a center of each adjacent elongated aperture 20 having a first length. A side of view of carrier 10 having longitudinal pitch 18 is shown in FIG. 10 (thickness of carrier 10 is not to scale).

The plurality of containers 5 also moves through applicating machine 30 and each container 5 is spaced apart from an adjacent container 5 by applicating machine 30. The spacing between adjacent containers 5 as they enter applicating machine 30 depends upon spacers positioned within applicating machine 30. The spacers are set to accommodate the largest diameter container 5 to be used in applicating machine 30.

Exiting applicating machine 30, adjacent containers 5 are spaced apart at least a distance approximately equal to their respective maximum diameters 7. Maximum diameter 7 is often not uniform across container 5 because of the numerous contoured containers 5 currently utilized. Carrier 10 having the characteristics described in this Specification permits a tight configuration of package 15 regardless of contour of container 5, in part, because of the stretch of carrier 10 in the lateral direction.

Figure 11:
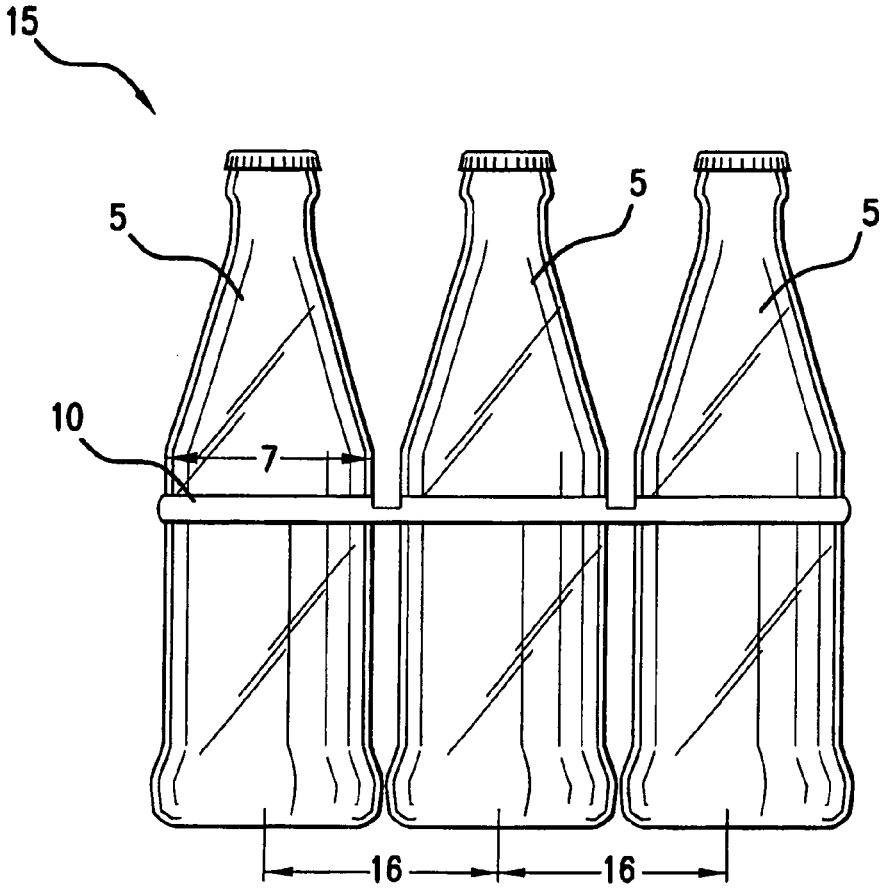
FIG. 11 is a side view of a package according to one preferred embodiment of this invention.

As discussed in more detail below, carrier 10 is positioned over the plurality of containers 5 whereby each elongated aperture 20 engages with one of the containers to form package 15 having a container pitch 16 between a center of adjacent containers 5 with a second length shorter then the first length. In practice, carrier 10 having elongated apertures 20 is reduced in overall longitudinal length subsequent to application to containers 5 and thus longitudinal pitch 18 is reduced in length to container pitch 16 after application. FIG. 11 shows container pitch 16 following application to containers 5.

According to one specific embodiment of this invention, the first length, or longitudinal pitch 18 of elongated apertures 20 in carrier 10, is approximately 3.0", prior to application to containers 5. In this specific embodiment, the second length, or container pitch 16 of elongated apertures 20 after application to containers is approximately 2.6". As a result, the first length prior to positioning over containers 5 is approximately 1.15 times greater than the second length after positioning over containers 5.

In practice, each group of containers 5, regardless of size, enters applicating machine 30 at a first constant spacing or pitch, such as 3" between centers of adjacent containers 5. Following application of carrier 10 to containers 5, containers 5 exit applicating machine at a second constant spacing or pitch, which is dependent upon the diameter of the specific containers used in the package and not necessarily equal to the first constant pitch, such as 2.6" between centers of adjacent containers 5. As a result, a single applicating machine 30 and a single carrier 10 is all that is required to package a group of containers 5 having any number of maximum diameters 7, i.e., 2.6" diameter containers may be packaged with the same equipment as 3.0" diameter containers.

Figure 5:
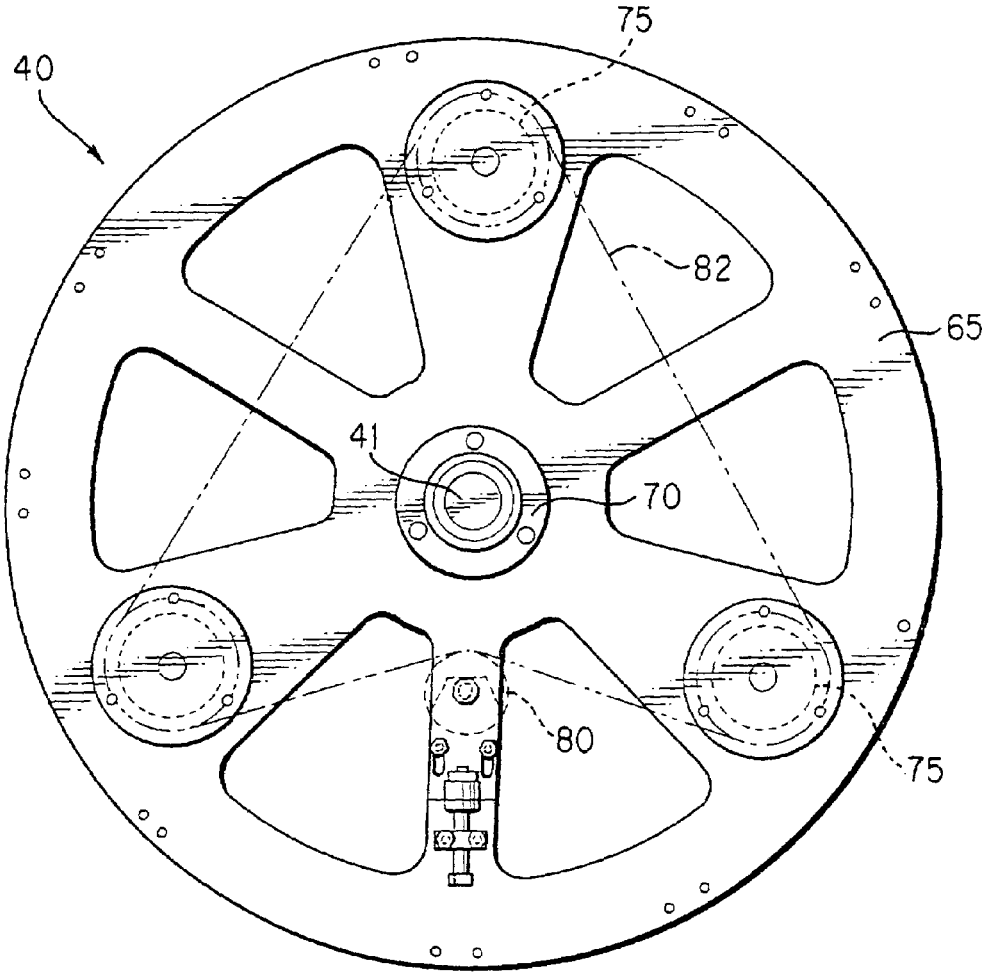
FIG. 5 is a side view of a drum according to one preferred embodiment of this invention.
Figure 6:
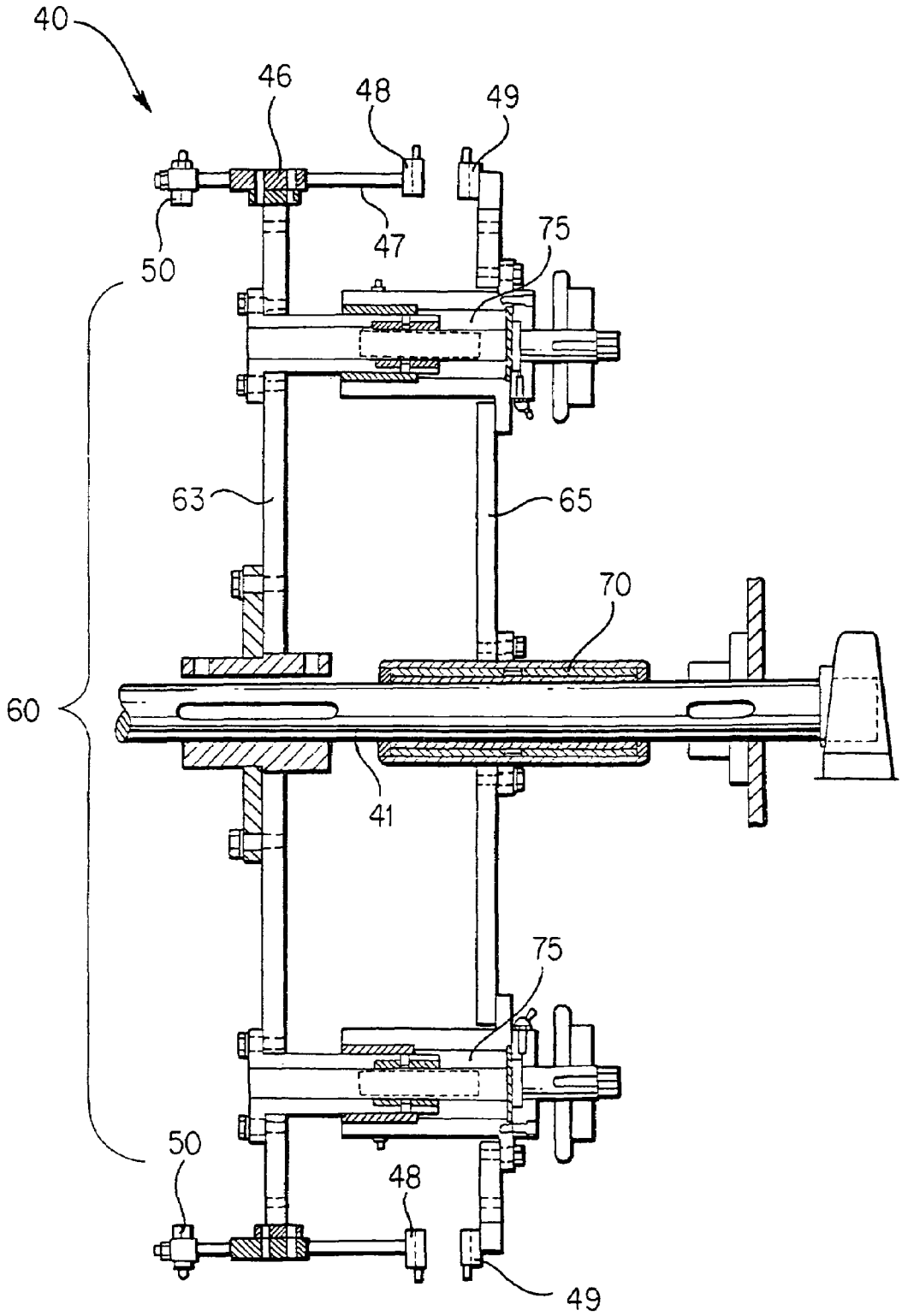
FIG. 6 is a front cross-sectional view of the drum shown in FIG. 5 further showing the additional detail of jaw pairs.
Figure 7:
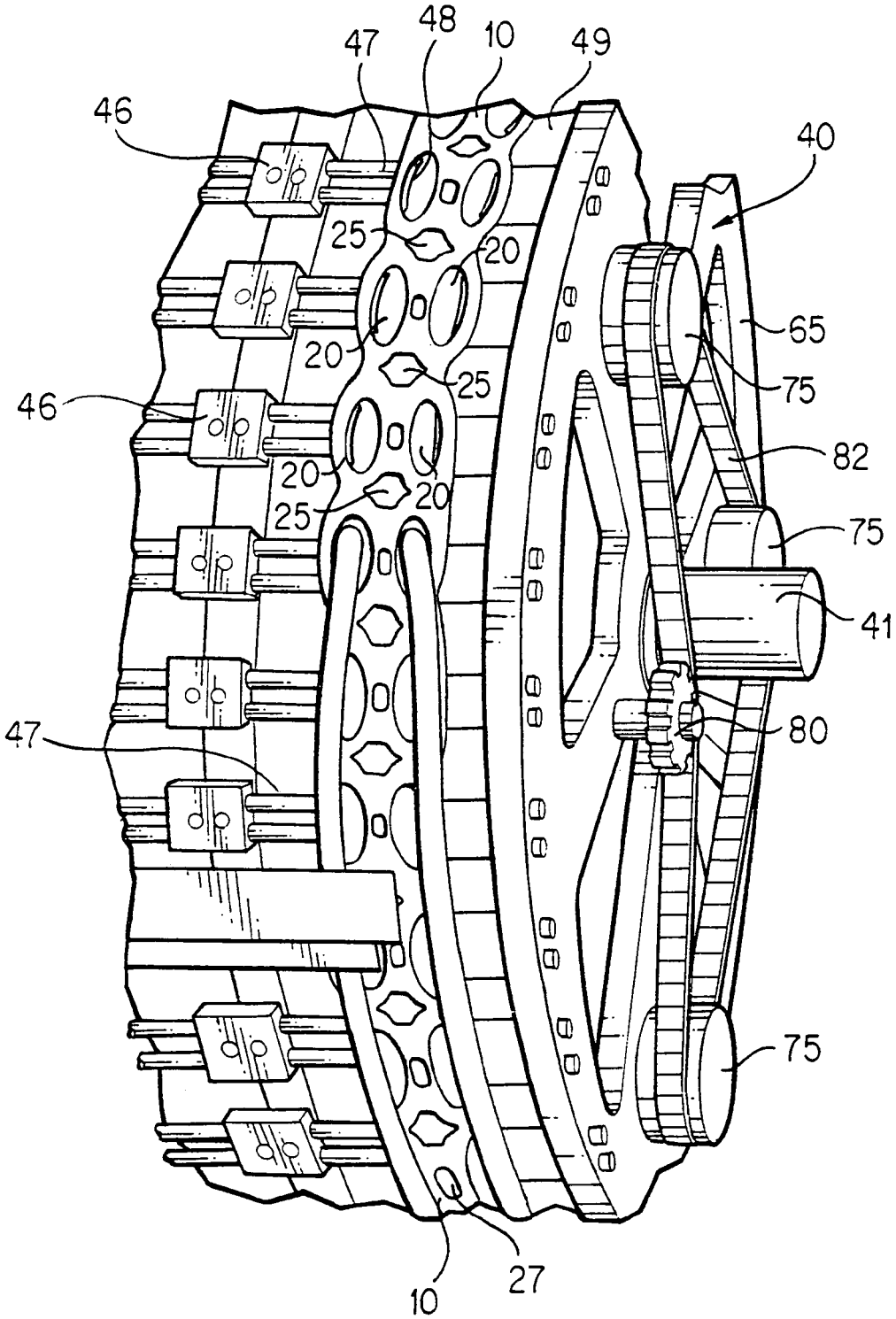
FIG. 7 is a diagrammatic perspective view of a carrier moving through a drum according to one preferred embodiment of this invention.

Carrier 10 is preferably spooled through applicating machine 30 including drum 40, shown in FIGS. 5–7. Guide plate 32, shown in FIG. 2, urges carrier 10 into engagement with drum 40. Drum 40 preferably comprises a cylindrical member rotatable about shaft 41. A plurality of jaw pairs 45, not shown in FIG. 5, are equally spaced around a perimeter of drum 40. Circumferential positions of jaw pairs 45 around the perimeter of drum 40 are preferably permanently fixed.

Figure 8:
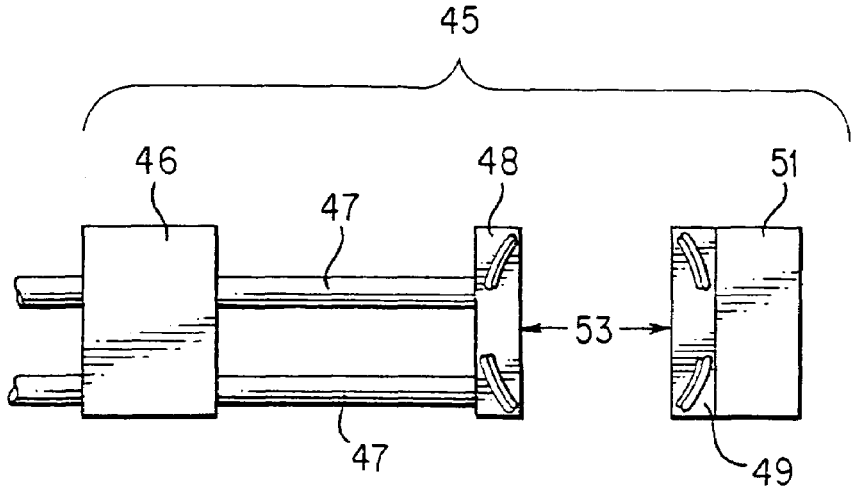
FIG. 8 is a top view of the jaw pairs in a closed position according to one preferred embodiment of this invention.
Figure 9:
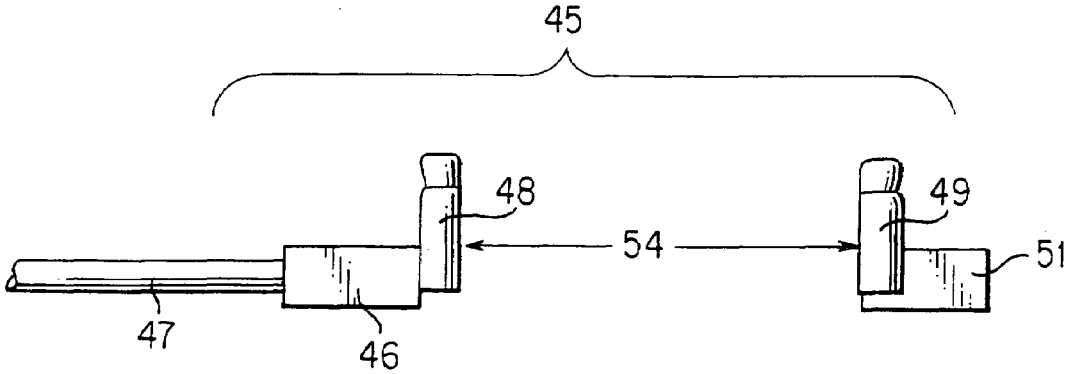
FIG. 9 is a side view of the jaw pairs shown in FIG. 8 extended in an open position.

As shown in FIGS. 8 and 9, according to one preferred embodiment of this invention, each jaw pair 45 comprises fixed supporting block 46, adjustable supporting block 51, two rods 47, moveable jaw 48 and fixed jaw 49. Supporting blocks 46, 51 are preferably connected with respect to drum 40. Adjustable supporting block 51 is preferably a disk or plate. Rods 47 are preferably journaled through fixed supporting block 46 in a parallel spaced relationship as shown in FIG. 8. Moveable jaw 48 is connected with respect to rods 47 thereby resulting in moveable jaw 48 that longitudinally reciprocates relative to fixed supporting block 46. Conversely, fixed jaw 49 is preferably directly connected to adjustable supporting block 51, or in another preferred embodiment, directly connected to adjustable hub 65. Fixed jaw 49 therefore does not move relative to adjustable supporting block 51 and/or adjustable hub 65.

According to one preferred embodiment of this invention, each fixed jaw 49 is aligned around one perimeter edge of drum 40 and each moveable jaw 48 is aligned opposite each corresponding fixed jaw 49. Each resulting jaw pair 45 is preferably spaced equidistantly around the perimeter of drum 40 from each other jaw pair 45.

According to one preferred embodiment of this invention, shown in FIGS. 8 and 9, each jaw pair 45 is movable between a closed position 53 and an open position 54 along an axis parallel to the axis of shaft 41. The closed position 53 comprises a relative position of jaw pair 45 when rods 47 are extended through supporting blocks 46 so that moveable jaw 48 is in a closest desired position relative to fixed jaw 49. The open position 54 comprises a relative position of jaw pair 45 when rods 47 are retracted through supporting blocks 46 so that moveable jaw 48 is in a farthest desired position relative to fixed jaw 49. In one preferred embodiment of this invention, jaw pairs 45 are moved between the open position 54 and the closed position 53 through the use of a cam roller 50 (FIG. 6) connected with respect to rods 47 and a cam (not shown) which is independently fixed with respect to drum 40. Therefore, the relative position of moveable jaw 48 with respect to fixed jaw 49 changes as drum 40 is rotated through a full 360° rotation.

Each jaw pair 45 is configured to grip carrier 10 with moveable jaw 48 and fixed jaw 49 engaged through each transverse pair of elongated apertures 20 in carrier 10. The circumferential spacing between adjacent jaw pairs 45 is preferably approximately equal to pitch 18 of carrier 10. The lateral spacing between moveable jaw 48 and fixed jaw 49 in the closed position 53 is preferably slightly less than width 19 between transverse pairs of elongated apertures 20. As shown in FIG. 7, carrier 10 is engaged with moveable jaw 48 and fixed jaw 49 of drum 40 prior to application to containers 5.

Drum 40 further comprises adjustment means 60 for predetermined and precise adjustment of a distance between jaws, preferably moveable jaw 48 and fixed jaw 49, of each jaw pair 45 in the closed position 53. Preferably, adjustment means 60 adjusts adjustable block 51 and/or fixed jaw 49 of each jaw pair 45. In one preferred embodiment of this invention, adjustment means 60 adjusts each fixed jaw 49 of jaw pairs 45 simultaneously around the entire circumference of drum 40. In one preferred embodiment of this invention, in addition to the distance between the fixed jaw 49 and the moveable jaw 48, a width of guide plate 32 may be adjusted to correctly urge carrier 10 into engagement with drum 40.

In one preferred embodiment of this invention, drum 40 comprises stationary hub 63 and adjustable hub 65. Adjustment means 60 preferably comprises adjustable hub 65 journaled with respect to stationary hub 63 of drum 40. Preferably, adjustable hub 65 is slidably connected with respect to stationary hub 63 through a center hub assembly 70 around shaft 41 of drum 40. In addition, in one preferred embodiment of this invention, three adjuster guide assemblies 75 are positioned around drum 40 between stationary hub 63 and adjustable hub 65 at equal intervals. Preferably, adjuster guide assemblies 75 are synchronized using roller chain 82. Idler 80 is used to eliminate slack in roller chain 82. Adjustable hub 65, idler 80 and other adjustable components of applicating machine 30 are preferably adjusted using one or more simple hand tools, such as a box wrench or open end wrench, to facilitate quick adjustment of drum 40. Therefore, when a smaller diameter container is packaged, a smaller size carrier 10 is required and adjustable hub 65 is readily and quickly adjustable.

As shown in FIGS. 7–9, as jaw pairs 45 move with the rotation of drum 40 from a closed position 53 to an open position 54, elongated apertures 20 within carrier 10 stretch to accommodate container 5. Carrier 10 in a stretched condition is positioned over a plurality of containers 5 so that each elongated aperture 20 engages with one container 5. Upon engagement with containers 5, carrier 10 is released from jaw pair 45 and grips a perimeter of container 5. Finally, carrier 10 is cut into desired size to create package 15 such as a six-pack having two longitudinal rows and three transverse ranks.

If a group of second containers 5 having a different diameter is packaged, adjustment means 60 is adjusted to engage carrier 10 having a different width, such as width 19, but a common pitch 18 from every other carrier 10 used in combination with applicating machine 30 according to this invention. Therefore, if a smaller diameter container is packaged and a smaller size carrier 10 is required, adjustable hub 65 is moved inwardly toward stationary hub 63. As a result, the distance between moveable jaw 48 and fixed jaw 49 in the closed position 53 is reduced and a new, smaller carrier 10 is engaged with jaw pairs 45 for application. Conversely, if a larger diameter container is packaged and a larger size carrier 10 is required, adjustable hub 65 is moved outwardly away from stationary hub 63. As a result, the distance between moveable jaw 48 and fixed jaw 49 in the closed position 53 is expanded and a new, larger carrier 10 is engaged with jaw pairs 45 for application.

A preferred range of container diameters accommodated by a single applicating machine 30 according to this invention is an approximate 1" range, such as between 2" and 3". Although this range of container diameters accounts for a majority of all containers 5 currently available in multi-package format, other ranges of container diameters such as between 2½" and 3½" or between 3" and 4" are also contemplated by this invention.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

We claim:

1. A method of packaging multiple containers in unitized packages, wherein a first unitized package includes containers having a first diameter and a second unitized package includes containers having a second diameter, wherein the second diameter is at least 10% smaller than the first diameter, the method comprising the steps of:

providing containers having the first diameter to an applicating machine, said applicating machine including a drum with a plurality of jaw pairs, each jaw pair spaced at a pitch length from a circumferentially adjacent pair;

moving a first carrier through said applicating machine, said first carrier having a plurality of transverse pairs of apertures, centers of each transverse pair of apertures spaced at said pitch length from centers of longitudinally adjacent transverse pairs;

positioning said first carrier over the containers having the first diameter to form the first unitized package;

adjusting a transverse distance between each jaw pair of said plurality of jaw pairs around a circumference of the drum while maintaining said pitch length between circumferentially adjacent jaw pairs;

providing containers having the second diameter to said applicating machine;

moving a second carrier through said applicating machine, said second carrier having a plurality of transverse pairs of elongated apertures, centers of each transverse pair of elongated apertures spaced at said pitch length from centers of longitudinally adjacent transverse pairs; and positioning said second carrier over the containers having the second diameter to form the second unitized package.

2. The method of claim 1 wherein said elongated apertures in said second carrier, in an unstressed condition prior to application to the plurality of containers, are approximately four to six times longer than wide.

3. The method of claim 1 wherein the first diameter is approximately 3.0" and the second diameter is approximately 2.6".

4. The method of claim 1 wherein the first diameter is approximately 3.0" and the second diameter is approximately 2.4".

5. The method of claim 1 wherein the first diameter is approximately 2.6"and the second diameter is approximately 2.3".

6. The method of claim 1 further comprising:

reducing an overall length of said second carrier after said second carrier is positioned over the containers to form said second package.

7. The method of claim 1 further comprising:

moving an adjustable hub of said drum to adjust said transverse distance between each jaw pair of said plurality of jaw pairs around a circumference of the drum while maintaining said pitch length between circumferentially adjacent jaw pairs.

8. A method of packaging multiple containers in a unitized package, the method comprising the steps of:

providing a first plurality of containers having a first diameter to an applicating machine, said applicating machine including a drum with a plurality of jaw pairs, each jaw pair spaced at a first length from a circumferentially adjacent jaw pair;

moving a first carrier through said applicating machine, said first carrier having a plurality of apertures and a pitch equaling said first length between a center of each longitudinally adjacent aperture;

positioning said first carrier over said first plurality of containers whereby each aperture engages with one container to form a package having a first container pitch between a center of adjacent containers;

adjusting a transverse distance between each jaw pair of said plurality of jaw pairs around a circumference of said drum while maintaining said first length;

providing a second plurality of containers having a second diameter to said applicating machine, said second diameter at least 10% smaller than said first diameter;

moving a second carrier through said applicating machine, said second carrier having a plurality of elongated apertures oriented in a longitudinal direction of said second carrier and a pitch between a center of each adjacent elongated aperture having said first length; and positioning the second carrier over said second plurality of containers whereby each elongated aperture engages with one container to form a package having a second container pitch between a center of adjacent containers, said second container pitch smaller than said first length.

9. The method of claim 8 further comprising:

positioning a plurality of relief holes between adjacent longitudinal rows of elongated apertures in the second carrier.

10. The method of claim 8 wherein the first diameter is approximately 3.0" and the second diameter is approximately 2.6".

11. The method of claim 8 wherein the first diameter is approximately 3.0" and the second diameter is approximately 2.4".

12. The method of claim 8 wherein the first diameter is approximately 2.6" and the second diameter is approximately 2.2".

13. The method of claim 8 further comprising:

reducing an overall length of said second carrier after said second carrier is positioned over the containers to form the package.

14. The method of claim 8 further comprising:

moving an adjustable hub of said drum to adjust said transverse distance between each jaw pair.

15. A method of packaging multiple containers in unitized packages, wherein a first unitized package includes containers having a first diameter and a second unitized package includes containers having a second diameter, wherein the second diameter is at least 10% smaller than the first diameter, the method comprising the steps of:

providing containers having the first diameter to an applicating machine;

moving a first carrier through said applicating machine, said first carrier having a plurality of transverse pairs of apertures, centers of each transverse pair of apertures spaced at a pitch length from centers of longitudinally adjacent transverse pairs;

positioning said first carrier over the containers having the first diameter to form the first unitized package;

adjusting said applicating machine to accommodate a second carrier having a same said pitch length as said first carrier;

providing containers having the second diameter to said applicating machine;

moving said second carrier through said applicating machine; and positioning said second carrier over the containers having the second diameter to form the second unitized package.

16. The method of claim 15 further comprising:

adjusting adjacent jaw pairs around a drum of said applicating machine to accommodate said second carrier while maintaining a same said pitch length between said first carrier and said second carrier.

* * * * *